US008776282B2

(12) United States Patent
Brawner

(10) Patent No.: US 8,776,282 B2
(45) Date of Patent: Jul. 15, 2014

(54) DUAL FLUSH TOILET FILL VALVE ASSEMBLY

(76) Inventor: William Matthews Brawner, Raleigh, NC (US)

( * ) Notice: Subject to any disclaimer, the term of this patent is extended or adjusted under 35 U.S.C. 154(b) by 236 days.

(21) Appl. No.: 13/199,310

(22) Filed: Aug. 25, 2011

(65) Prior Publication Data

US 2013/0047325 A1 Feb. 28, 2013

(51) Int. Cl.
*E03D 1/14* (2006.01)

(52) U.S. Cl.
USPC ..... 4/324; 4/325; 4/415

(58) Field of Classification Search
CPC ..... E03D 1/14; E03D 1/142; E03D 1/144; F16K 31/24; F16K 31/18
USPC ..... 4/324, 325, 378, 379, 391, 394, 395, 4/405, 412
See application file for complete search history.

(56) References Cited

U.S. PATENT DOCUMENTS 761,758 A * 6/1904 Burr ..... 4/381
818,185 A * 4/1906 Minton ..... 4/381
3,141,177 A 7/1964 Kertell
4,082,110 A * 4/1978 Woodbury, Jr. ..... 137/426
4,135,263 A * 1/1979 Anderson ..... 4/324
4,536,900 A * 8/1985 Hayes ..... 4/324
4,651,359 A 3/1987 Battle
4,748,699 A 6/1988 Stevens
4,945,581 A 8/1990 Harris
5,081,720 A 1/1992 Ames et al.
5,191,661 A 3/1993 Chang
5,211,204 A 5/1993 Mikol
5,287,882 A * 2/1994 Mikol ..... 137/410
5,673,440 A * 10/1997 Carmona ..... 4/325
5,699,563 A * 12/1997 McClure ..... 4/325
6,385,788 B1 * 5/2002 Wasielewski ..... 4/415

* cited by examiner

*Primary Examiner* — Huyen Le
*Assistant Examiner* — Erin Deery
(74) *Attorney, Agent, or Firm* — MacCord Mason PLLC

(57) ABSTRACT

A toilet fill valve assembly for installation into a toilet tank is described, which includes a supply tube, a valve regulating the flow of water, an actuator to open and close the valve; a vertical transmission shaft with upper and lower stops rotatable around its longitudinal axis between first and second positions; a float moveable upwardly under the buoyance force of water entering the tank to engage the lower stop when the shaft is in its first position and the upper stop when the shaft is in its second position, the movement of the float closing valve when the float engages one of the stops; a controller to move the shaft from its first position to its second position, allowing the float to engage the upper stop and increase the volume of water entering the tank between flushes; and a guide rotating the shaft to its first position upon flushing.

19 Claims, 9 Drawing Sheets

DUAL FLUSH TOILET FILL VALVE ASSEMBLY

BACKGROUND OF THE INVENTION (1) Field of the Invention

The present invention generally relates to a dual flush fill valve assembly for a toilet, and in particular to a dual flush fill valve assembly having a means to increase the volume of water in a toilet tank between flushes.

(2) Description of the Prior Art

Toilets can be found in almost every home and office building in the developed world and commonly use a fixed and excessive amount of water per flush. Although people prefer not to waste this water, there is no pleasant alternative to using the toilet. People prefer a toilet that uses only the amount of water needed to remove waste.

With the ever-increasing population, the conservation of water has become a greater priority. Efforts from local to global organizations are encouraging people to conserve water. In an effort to conserve, people are doing everything from displacing tank water with tank inserts to installing entirely new toilet systems. However, displacing a consistent amount of water to flush two types of waste (liquid and solid) is still an inefficient use of water, and installing a new toilet system is costly and labor intensive. These factors are major deterrents to maintaining a toilet that minimizes the use of water. These problems exist in private and professional situations where toilets are used.

In an effort to save water, dual flush toilet designs have previously been introduced that provide different flush volumes depending on the type of waste. U.S. Pat. No. 6,484,327 B2 to Hand (2002) shows a common two valve strategy that allows water to exit the tank from either an upper or lower valve. Given the fixed amount of water in the tank, these valve positions dispense a low and high volume of water, respectively. While this design, and the other dual valve systems like it allow varying volumes of water to be dispensed, multiple valves provide more opportunities for water to leak past the valves. The likelihood of a continually refilling ('Running') toilet is three times greater than a single valve toilet since a leak could occur at each of the two valves or at the point where the upper outflow tube section is adjustably coupled to the lower outflow tube section. Additionally, the installation of such a device requires affixing and sealing the outflow tube to the bottom of the toilet tank. This cannot be done without removing the tank, making installation difficult. Finally, this design requires multiple actuation lines as a connection must be made to each of the valves.

U.S. Pat. No. 6,829,787 B1 to Pipenburg (2004) shows a dual valve system that dispenses a low volume of water if the handle is partially depressed and a large volume if the handle is fully depressed. As with the previous design, this design introduces more leak opportunities than a single valve system and requires toilet tank removal for installation. Additionally, this and similar designs require a significant amount of component changes to convert a standard gravity flow toilet to a dual flush system. As the effort to save resources applies to water and other resources (plastic), it is preferred to reduce the waste created by component differences when upgrading to a dual flush system.

U.S. Pat. No. 7,062,801 B2 to Oliver (2006) shows another common way of controlling flush volume. The flapper valve, having an air pocket to keep the valve raised and open while submerged, is connected to a means for removing the air. While this design appears to successfully offer variable flush volumes, it uses a complex air valve system that presents a greater opportunity for malfunctions due to air leaks and blockages.

All the devices heretofore known suffer from one or more of the following disadvantages:

a. Failure to be adaptable to existing toilet systems.

b. Failure to use variable amounts of water per flush based on the type of waste.

c. Failure to conserve resources by requiring only a minimal amount of component changes to convert a conventional gravity fed toilet to a dual flush toilet.

d. Failure to provide dual flush functionality without the use of electricity.

e. Failure to allow the installer to adjust the volumes of each flush mode.

f. Device is specific to only one brand of toilet.

g. Creation of additional potential leak points.

h. Inability to be installed without significant effort such as removing the toilet tank.

i. Device requires modification or replacement of the existing flapper valve or flapper valve actuation system (flush lever).

j. Device fails to remove water from the bottom of the tank on every flush allowing the buildup of contaminants on the bottom of the tank.

SUMMARY OF THE INVENTION

The present invention relates to an improved toilet fill valve assembly that can be used as the fill valve assembly for new toilets or as a replacement fill valve. Unlike prior art fill valve assemblies, the present fill valve assembly fills the toilet tank to a relatively low volume of water during flushing, but enables the user to increase the volume of water in the tank prior to the next flush, if a greater volume of water is desired, e.g., in flushing solid wastes instead of liquid wastes.

A common type of toilet fill valve assembly is comprised of a supply tube in communication with a water supply, and a valve controlling flow of water from the water supply into the toilet tank. A float is slidable along the supply tube between lowered and raised positions. As water fills the tank, the float moves upward toward the raised position. The float is joined by an adjustable length connector shaft to the outer end of a valve actuator arm. When the float is raised to its upper position, it raises the actuator arm to close the valve, halting the flow of water into the tank. The fill valve assembly is used as part of a toilet that includes a water holding tank with a water discharge opening, a flapper valve covering the discharge opening, and a flush lever to raise the flapper valve.

The fill valve assembly of the present invention is similarly constructed except for the mechanism used to transfer the buoyancy of the float to an actuator arm to close the valve. Instead of a conventional connector shaft, the present invention uses a shaft having upper and lower stops, with the shaft being joined at its upper arm to the outer end of the actuator arm. The float, instead of being connected via a linkage to the lower end of the shaft, includes a tab that is positioned to engage the lower stop when the shaft is in a first position and the upper stop when the shaft is in a second position. A manually operated controller is attached to the shaft for use in moving the shaft from its first position to its second position.

In operation, flushing of the tank discharges water from the tank into the toilet bowl, letting the float fall to its lower position, thereby lowering the actuator arm and allowing water to flow into the tank from the water supply source. As the water enters the tank the float is raised upward due to its buoyance until the float tab engages the lower stop of the shaft, causing the shaft to move upward, closing the valve, and capturing a first volume of water in the tank.

If the user wishes to use this volume of water, e.g., when flushing liquids, the user simply flushes the toilet again, which will repeat the above steps. However, if the user wants to use a larger quantity of water as when flushing solids, the user actuates the controller to disengage the float from the lower stop, allowing the float to move upward to engage the upper stop, which closes the valve, but only after additional water has flowed into the tank. Then, when the user flushes the toilet, this greater volume of water will flow into the toilet bowl. When the toilet is flushed, a reset mechanism returns the shaft to its initial position, so that the toilet will be filled to the first volume as noted above.

Generally, the toilet fill valve assembly is designed for installation into a toilet including a tank with a water discharge opening, a flapper valve covering said discharge opening, and a flush lever. The assembly includes a supply tube with a valve for regulating the flow of water in tube, and a valve actuator to open and close the valve. A transmission shaft with upper and lower stops and a longitudinal axis, the shaft having first and second positions, communicates with the valve actuator. A float is moveable upwardly along the supply tube to engage the shaft lower stop when the shaft is in its first position and the upper stop when the shaft is in its second position. When the float engages a stop, the upward buoyancy force of the float raises the shaft to close the valve actuator. A controller, which may be operated by the flush lever, moves the shaft from its first position to its second position, preferably by rotating the shaft about its longitudinal axis, to allow the float to engage the upper stop and allow an increased volume of water to enter said tank prior to flushing. A guide returns the shaft to its first position upon flushing the toilet.

In a first embodiment of the invention the bottom of the shaft has a wide base that prevents the float from sliding off the shaft. Mounted above and on the outermost diameter of the base is a slide that extends helically and partially surrounds the transmission shaft. Above the slide a protruding spline extends up the shaft toward the high level float stop. The lower end of the spline is the low level float stop.

In a second embodiment of the invention the transmission shaft contains a recessed channel in which a protrusion on the inside of the float tab travels and is contained. The lower end of the channel has a stop that prevents the float from sliding off the shaft. Above the stop the channel creates a slide by widening and extending helically, partially surrounding the transmission shaft. Above the slide a narrow portion of the recessed channel extends up the shaft toward the high level float stop. The widened channel on the lower end of the transmission shaft closes to form the narrow portion of the channel, creating a horizontal surface that is the low level float stop.

For each configuration, above the high level float stop an actuator connection protrusion provides a means to secure the actuator line. The top end of the shaft connects loosely to a conventional water supply valve and is held in place within opposing larger diameter sections to prevent vertical movement. An actuator cable connects the actuator connection protrusion to the slack part of the existing flapper valve actuator cable. This configuration is such that partially depressing the existing toilet handle transmits force to the actuator connection to rotate the transmission shaft. This rotation slides the first float stop, or spline, out of the path of the float tab by aligning it with the open side of the float tab. The float tab and float are free to move along the length of the spline until the second float stop is contacted.

For each embodiment the toilet tank will be filled to different levels depending on the location of the float stops along the transmission shaft. With the first float stop oriented within the float's path and below the second float stop, the float will contact the first float stop at a low water level, thus transmitting the float buoyancy force through the transmission shaft and turning off the water fill valve. Should a larger volume of flush water be required, partially depressing the existing flush lever will remove the first float stop from the float path and cause water to flow into the tank. Water continues to enter the tank until the float contacts and lifts the second float stop. The volume of water specified by the second float stop will be discharged when the toilet is flushed. Should the user not partially depress the lever to fill the tank to the high water level, only the volume of water specified by the first float stop (low volume) will discharge when flushed.

Flushing the toilet causes the float tab to slide to the bottom of the transmission shaft where it contacts the slide and rotates the first float stop back into the floats range of movement. This causes the system to always fill to the low volume water level after being flushed.

Thus, the invention defines a method for increasing the volume of water prior to flushing in the tank of a toilet comprised of a tank with a water discharge opening, a flapper valve covering said discharge opening, and a flush lever. The method comprises the steps of a) providing a fill valve assembly including a valve for regulating the flow of water into the tank, a float moveable upwardly along a pathway as water enters the tank, and upper and lower stops positionable in the pathway to engage the float, the valve being closed by the buoyancy force of the float against either of the stops; b) filling the tank with water until the buoyancy force of the float against the lower stop closes the valve; and c) removing the lower stop from the pathway and allowing the float to move upward until the buoyancy force of the float against the upper float closes the valve, providing a greater volume of water in the tank.

The device may further include pressure, cable, or electrical transmission and actuation methods between the toilet seat area and the pivotable float stop.

LIST OF REFERENCE NUMERALS

1. Supply tube
2. Inlet Valve Actuator
3. Transmission Shaft
4. Float
5. Float Tab
6. First Float Stop
7. Spline
8. Second Float Stop
9. Slide
10. Float Stop Spacers
11. Transmission Shaft Base

12. Actuator Cable
13. Actuator Cable Anchor
14. Flapper Valve
15. Flapper Valve Actuator Cable
16. Tank
17. Flush Lever
18. Water
19. Water Inlet Assembly

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
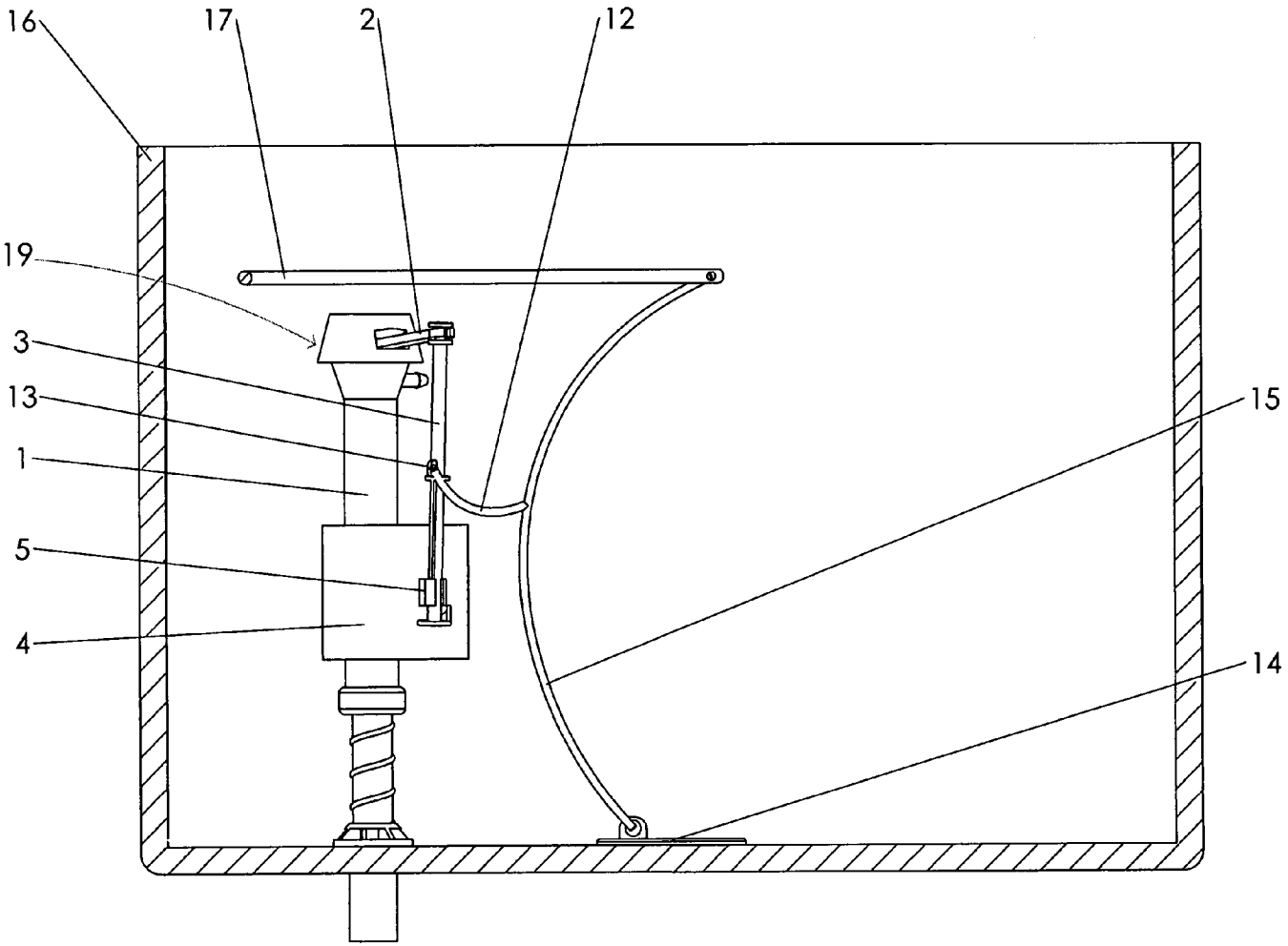
FIG. 1 Toilet Water Saving Device Composite
FIG. 2 Transmission Shaft
FIG. 3 Position 1: First Float Stop Engaged
FIG. 4 Position 2: First Float Stop Disengaged
FIG. 5 Position 3: Second Float Stop Engaged
FIG. 6 Position 4: System Reset Upon Flush
FIG. 7 Transmission Shaft with Float Stop Spacers
FIG. 8 Second Embodiment: Transmission Shaft

FIG. 1 shows a sectional view of the tank (16) with a composite view of the device components mounted within a tank (16). The conventional flush components are the flush lever (17) and a flapper valve (14) connected by a flapper valve actuator cord (15). The water inlet assembly (19) is anchored to the bottom of the tank (16) and is comprised of the supply tube (1), float (4), inlet valve actuator (2), and transmission shaft (3). An actuator cord (12) connects the flapper valve actuator cord (15) to the actuator cord anchor (13) on the transmission shaft (3).

Figure 2:
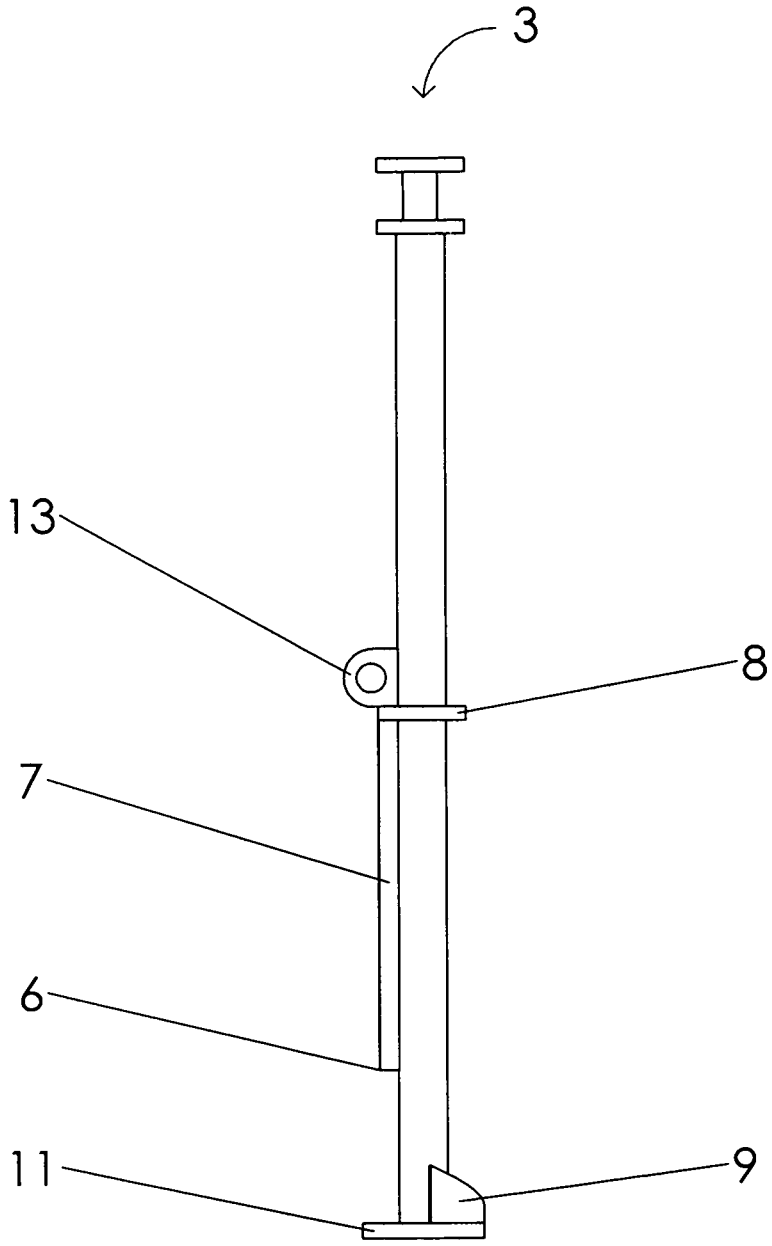

FIG. 2 shows a composite view of the transmission shaft (3). A helical slide (9) is mounted to the transmission shaft base (11) and extends upwardly, partially encircling the lower end of the transmission shaft (3). A predetermined distance above the slide (9) a radial spline (7) protrudes from the transmission shaft (3) and extends vertically to the second float stop (8). The bottom of the spline (7) is the first float stop (6). The actuator cable anchor (13) is mounted above the second float stop (8). At its upper end a portion of the transmission shaft (3) with apposing larger diameter sections provides a means to connect to the inlet valve actuator (2) (not shown).

Figure 3:
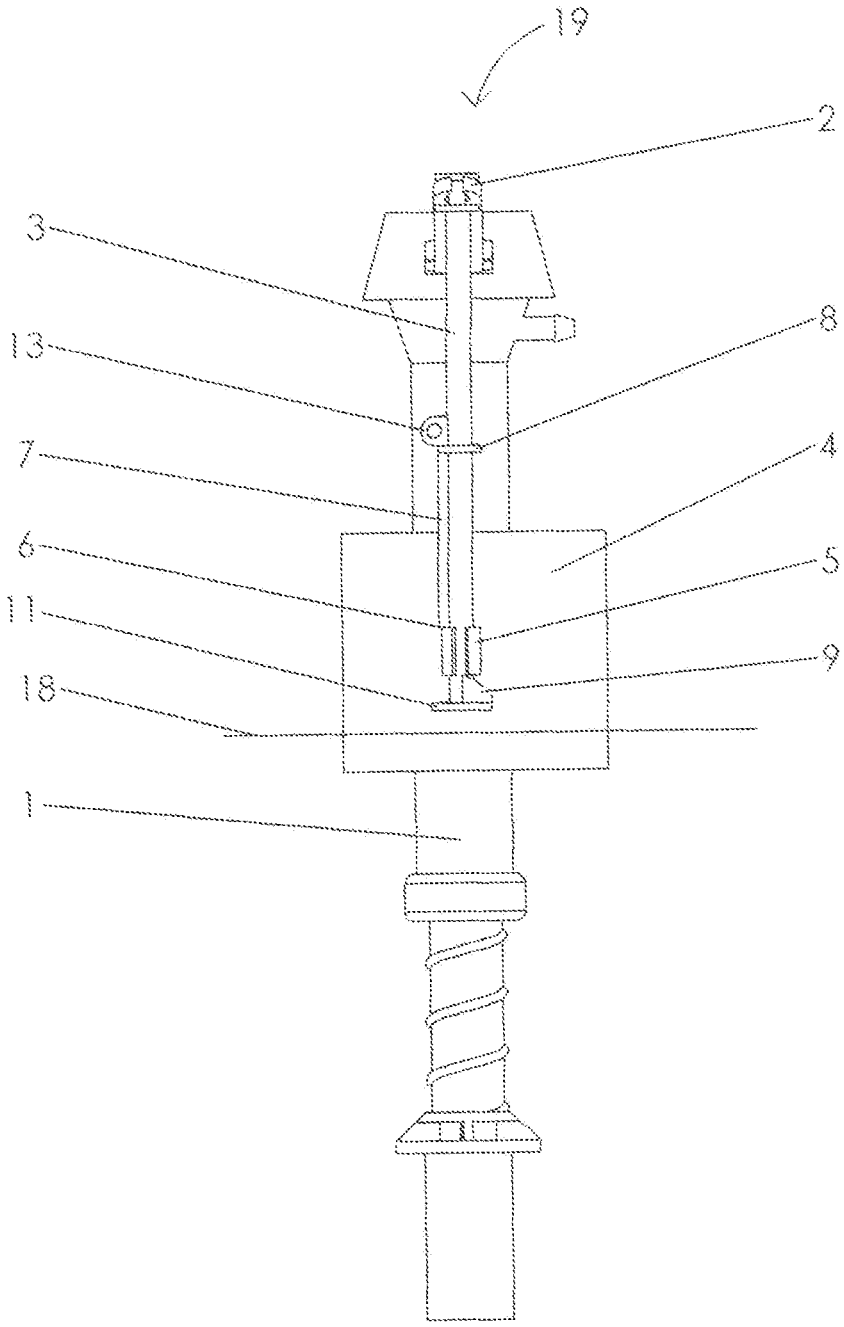

FIG. 3 shows position 1: First float stop engaged. The first float stop (6) is in the path of the float tab (5). With the float (4) suspended by the water (18), the float tab (5) maintains contact with the first float stop (6) and transmits the float's (4) buoyancy force through the transmission shaft (3). The inlet valve actuator (2) is in the raised (closed) position.

Figure 4:
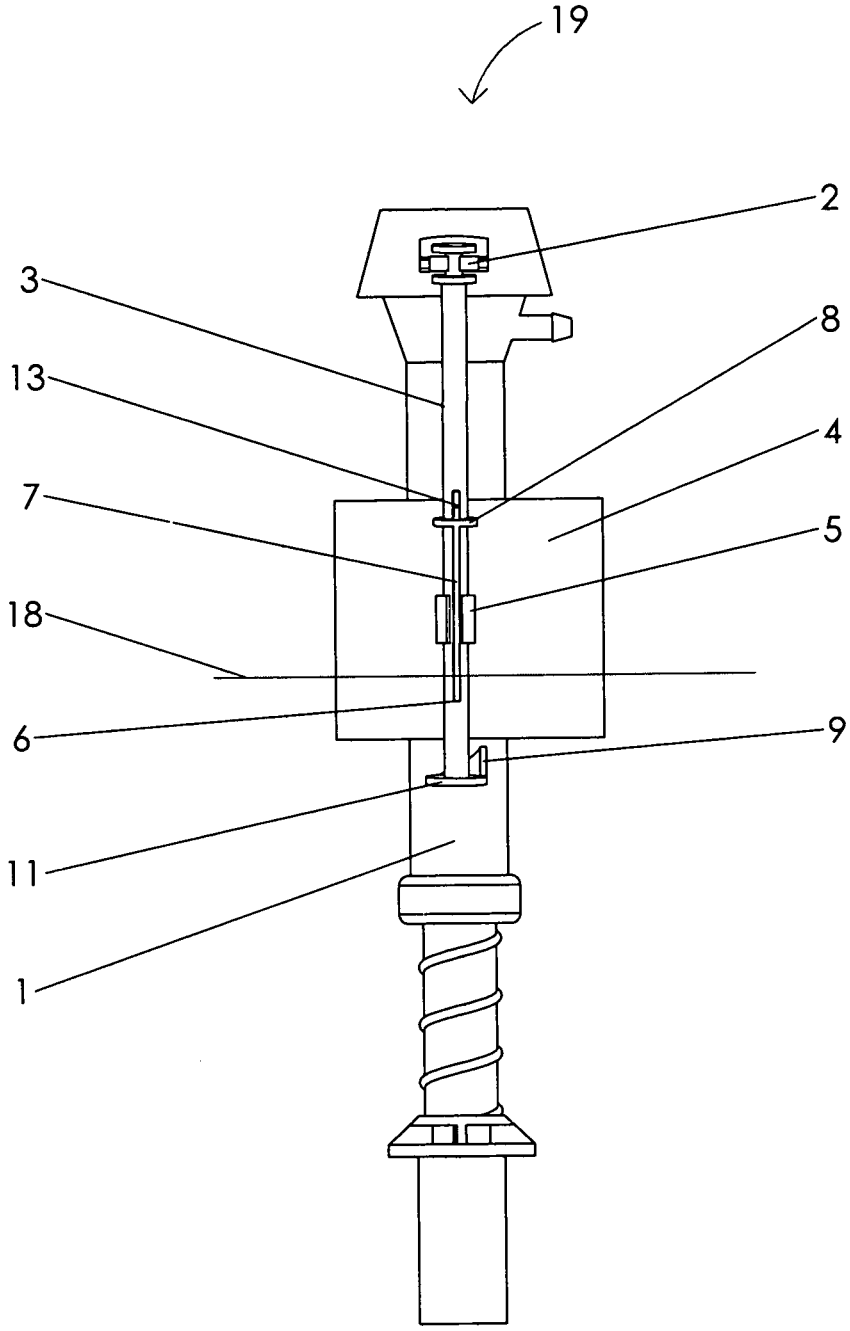

FIG. 4 shows position 2: First float stop disengaged. The transmission shaft (3) is rotated about its longitudinal axis such that the first float stop (6) is moved out of the path of the float tab (5). The inlet valve actuator (2) is in the lower (open) position causing the water (18) to flow into the tank (16) (not shown).

Figure 5:
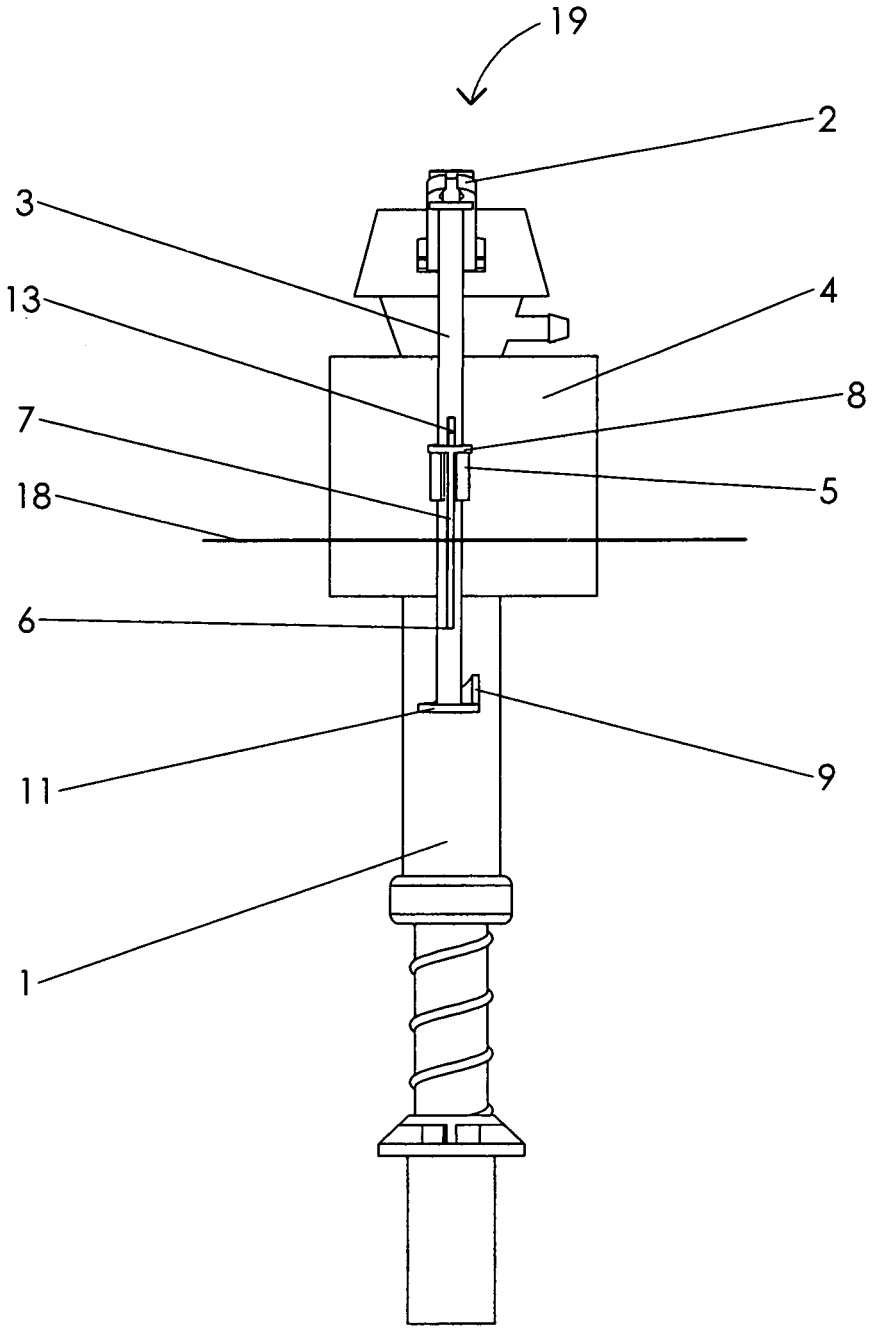

FIG. 5 shows position 3: Second float stop engaged. The rising water (18) has pushed the float (4) to its raised position on the transmission shaft (3) contacting the second float stop (8). The inlet valve actuator (2) is in the raised (closed) position.

Figure 6:
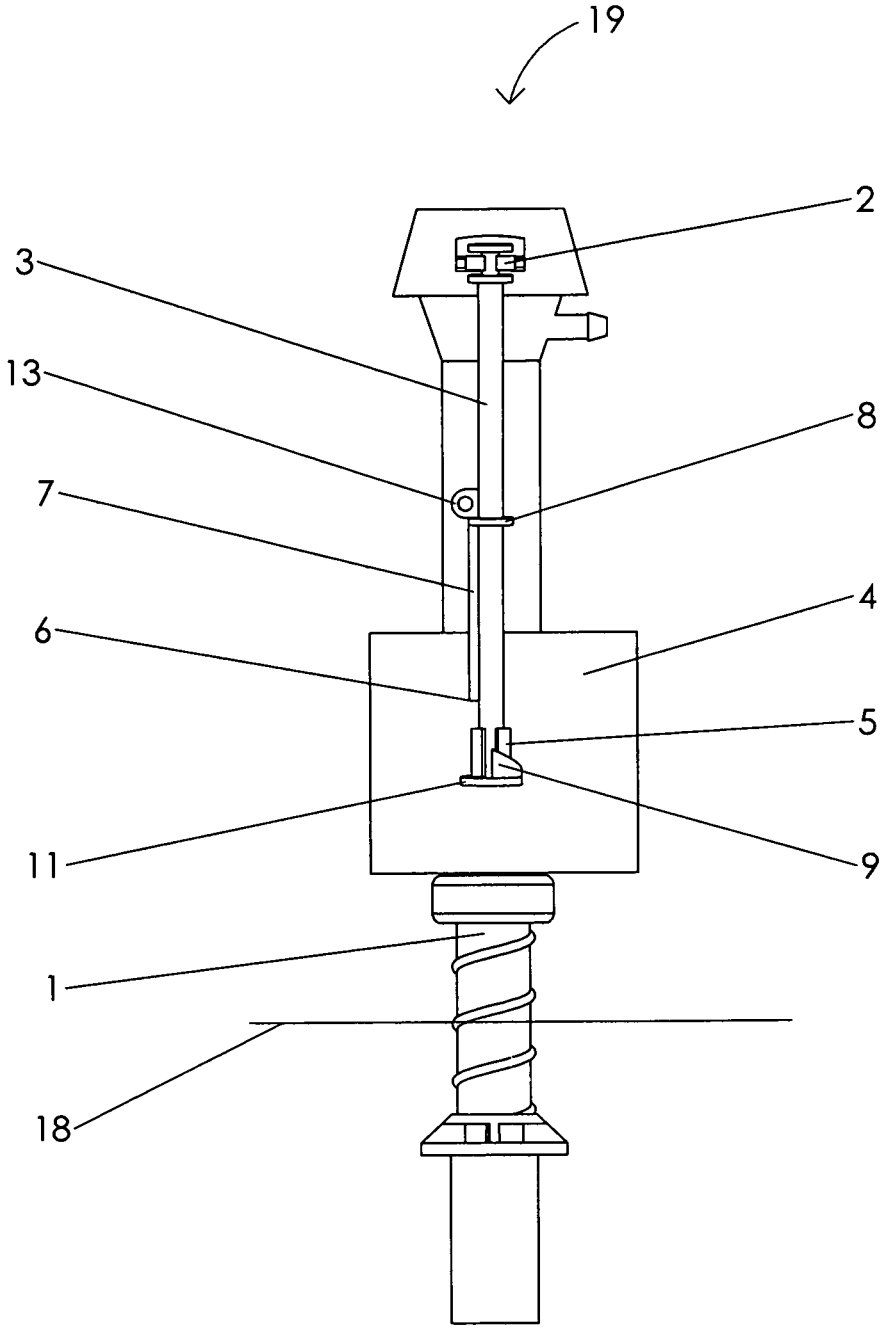

FIG. 6 shows position 4: System reset upon flush. With no water (18) to support the float (4), it falls to its lower position. In doing so, the float tab (5) contacts the slide (9) and rotates the transmission shaft (3) such that the first float stop (6) moves back into the path of the float tab (5). The inlet valve actuator (2) is in the lower (open) position. Once the water (18) level raises the float (4) to the first float stop (6), the system will have returned to Position 1: first float stop engaged.

Figure 7:
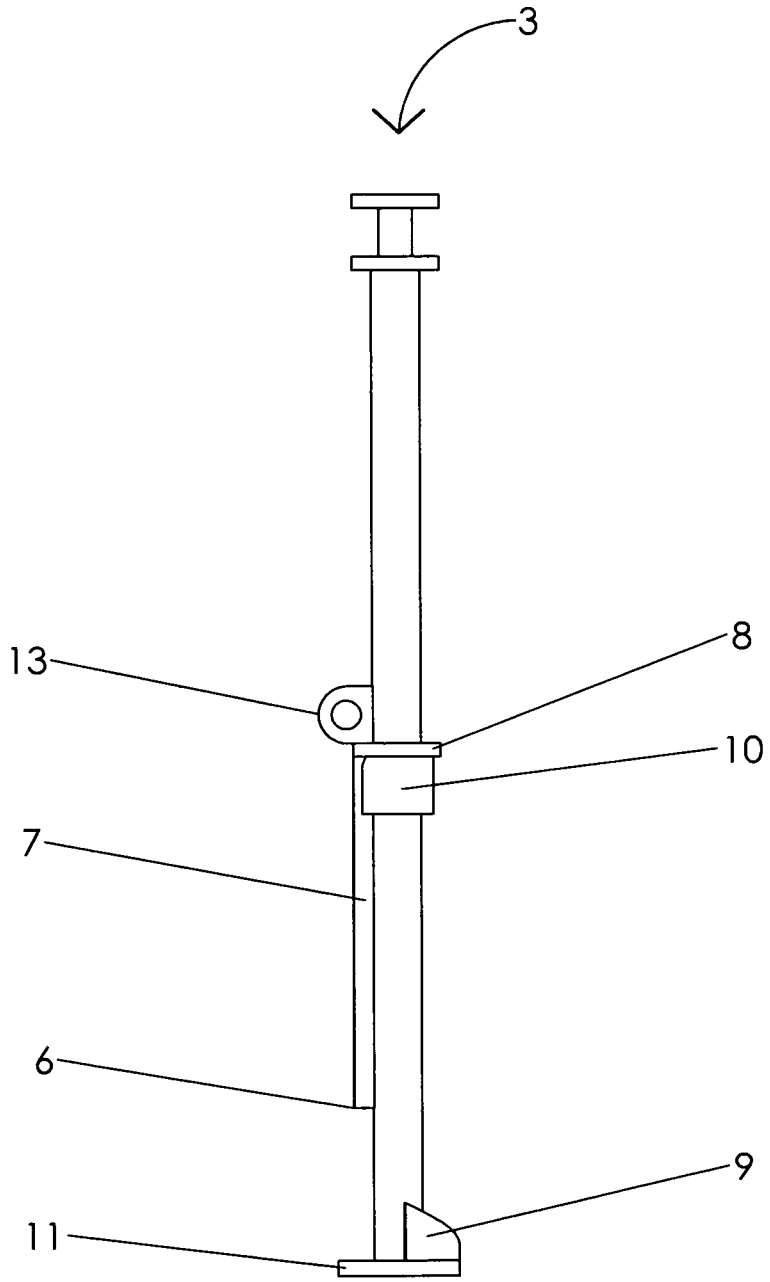

FIG. 7 shows the transmission shaft (3) with a float stop spacer (10). The slide (9), transmission shaft base (11), spline (7), first float stop (6), second float stop (8) and actuator cable anchor (13) are as depicted in FIG. 2.

Figure 8:
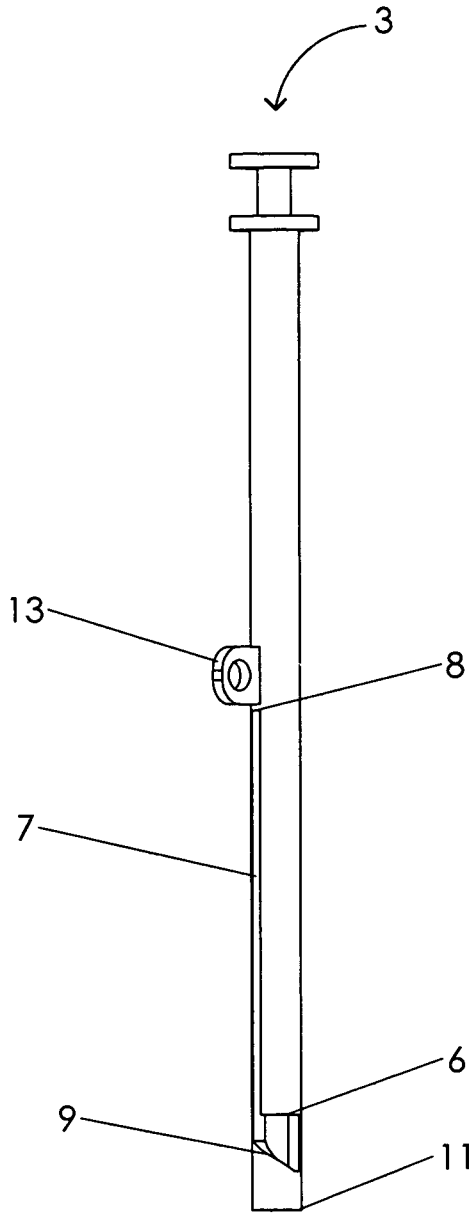

FIG. 8 shows the second embodiment: Transmission shaft. Above the transmission shaft base (11) the helical slide (9) is recessed into the transmission shaft (3) and extends upwardly, partially encircling the lower end of the transmission shaft (3). The first float stop (6) is on the upper side of the recessed area from the slide (9). Above the upper portion of the slide (9) a recessed spline (7) extends vertically to the second float stop (8). All recessed areas are of sufficient size to enclose and guide a pin on the inside of the float tab (5) (not shown). The actuator cable anchor (13) (not shown) is mounted above the second float stop (8). At its upper end a portion of the transmission shaft (3) with apposing larger diameter sections provides a means to connect to the inlet valve actuator (2) (not shown).

Figure 9:
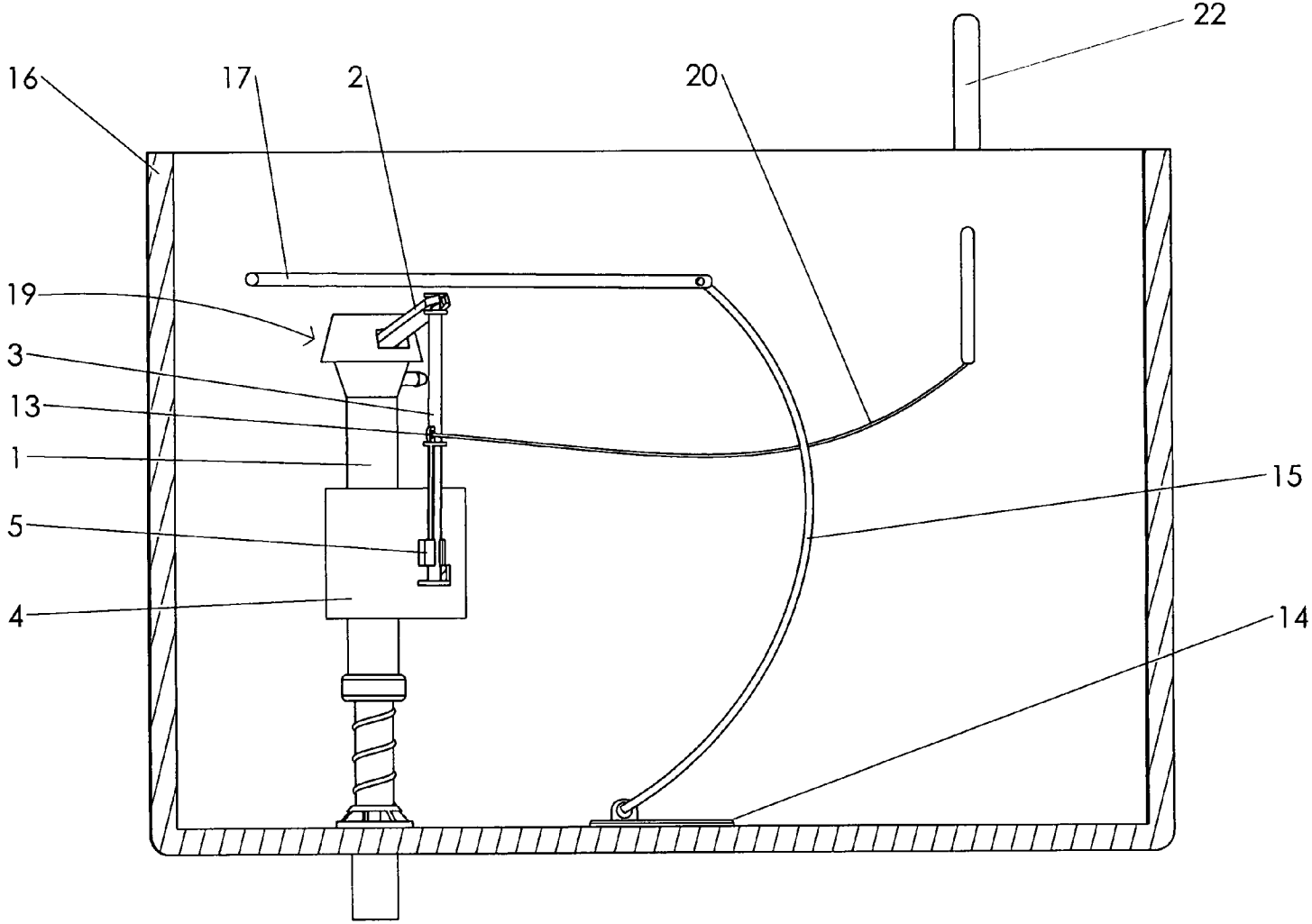
FIG. 9 illustrates an alternate embodiment of the invention in which the controller is separate from the flush lever.

As shown in FIG. 9, actuator cord (20) does not need to be connected to flapper valve actuator cord (15), but can be attached to the actuator cord anchor (13) on the transmission shaft (3) and pulled independently by handle (22).

Operation

Upon installation, the actuator cable (12) is fastened to the conventional flapper valve actuating cable (15) such that tension in the flapper valve actuating cable (15) transmits force to the transmission shaft (3). The low water volume level is set by adjusting the height of the conventional supply tube (1). The high water level volume is set by adding or removing float stop spacers (10) under the second float stop (8).

To use the small flush volume the user flushes the toilet the same way as a conventional toilet. With the tank (16) filled to the first float stop (6), the low volume of water is dispensed.

To use the large flush water volume the user partially depresses the flush lever (17) prior to requiring a large water volume flush. While not actuating the flapper valve (14), this removes the slack from the flapper valve actuator cable (15) and pulls the actuator cable (12). Force from the actuator cable (12) rotates the transmission shaft (3) and moves the first float stop (6) from above the float tab (5). With the first float stop (6) removed the buoyancy force from the float (4) is no longer transmitted through the transmission shaft (3) and the inlet valve actuator (2) moves to the open position. Water (18) enters the tank (16) until the float tab (5) contacts the second float stop (8) and raises the inlet valve actuator (2) to the off position. The larger volume of water (18) in the tank (16) will now be used when the toilet is flushed.

Independent of the water volume used to flush the toilet (not shown), when the system is flushed the float (4) drops with the water level (18). When the float tab (5) descends it contacts the slide (9) at the lower end of the transmission shaft (3). With the float tab (5) approximately horizontally stationary, the downward force of the float tab (5) on the slide (9) rotates the transmission shaft (3) such that the first float stop (6) moves back into the path of the float tab (5). This resets the system such that when the tank (16) refills, the first float stop (6) turns off the inlet valve actuator (2) with the lower volume of water (18) in the tank (16).

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A toilet fill valve assembly for regulating the water level within a toilet including a tank with a water discharge opening, a flapper valve covering said discharge opening, and a flush lever, said assembly comprising:

a) a supply tube;

b) a valve for regulating the flow of water in said tube;

c) an inlet valve actuator to open and close said valve;

d) a transmission shaft with upper and lower stops and a longitudinal axis, said shaft being rotatable around its longitudinal axis between first and second positions;

e) a float moveable upwardly along said supply tube to engage said lower stop when said shaft is in its first position to allow a first volume of water to enter said tank and said upper stop when said shaft is in its second position, the upward movement of said float raising said shaft to close said inlet valve actuator when said float engages one of said stops; and f) a controller to move said shaft from its first position to its second position, thereby allowing said float to engage said upper stop and allow an increased volume of water to enter said tank.

2. The assembly of claim 1, further including a guide to return said shaft to its first position upon flushing said toilet.

3. The assembly of claim 1, wherein said controller is operable by the toilet flush lever.

4. The assembly of claim 1, wherein said float includes a tab slidable along said shaft to selectively engage said stops.

5. The assembly of claim 1, wherein said shaft includes a radial spline with a lower end, said spine lower end forming said lower stop.

6. The assembly of claim 1, wherein said shaft includes a slot having a horizontal section forming said lower stop and an upper end forming said upper stop.

7. The assembly of claim 1, wherein said flush lever is connected to said flapper valve by a valve connector cord, and said controller is connected to said valve connector cord, whereby tightening of said cord moves said shaft from its first position to its second position.

8. A toilet fill valve assembly for increasing the volume of water in a toilet tank between flushes comprising:

a) a supply tube;

b) a valve for regulating the flow of water in said tube;

c) an inlet valve actuator to open and close said valve;

d) a vertical transmission shaft with upper and lower stops, said shaft being rotatable around its longitudinal axis between first and second positions;

e) a float moveable upwardly along said supply tube, said float including a tab to engage said lower stop when said shaft is in its first position to allow a first volume of water to enter said tank and said upper stop when said shaft is in its second position, the upward movement of said float raising said shaft to close said inlet valve actuator when said float engages one of said stops;

f) a controller to move said shaft from its first position to its second position, thereby allowing said float to engage said upper stop and allow an increased volume of water to enter said tank; and g) a guide to rotate said shaft to its first position upon flushing said toilet.

9. The assembly of claim 8, wherein said controller is a cord operable by the toilet flush lever.

10. The assembly of claim 8, wherein said float includes a tab slidable along said shaft to selectively engage said stops.

11. The assembly of claim 8, wherein said shaft includes a spline with a lower end, said spine lower end forming said lower stop.

12. The assembly of claim 8, wherein said shaft includes a slot having a horizontal section forming said lower stop and an upper end forming said upper stop.

13. The assembly of claim 8, wherein said flush lever is connected to said flapper valve by a valve connector cord, and said controller is connected to said valve connector cord, whereby tightening of said cord rotates said shaft from its first position to its second position.

14. A method for regulating the volume of water prior to flushing in the tank of a toilet comprised of a tank with a water discharge opening, a flapper valve covering said discharge opening, and a flush lever, said method comprising:

a) providing a fill valve assembly including a valve for regulating the flow of water into said tank a float moveable upwardly along a pathway as water enters said tank, and upper and lower stops positionable in said pathway to engage said float, said valve being closed by the buoyant force of said float against either of said stops;

b) filling said tank with water until the buoyancy force of said float against said lower stop closes said valve to allow a first volume of water to enter said tank; and c) rotating said lower stop from said pathway and allowing said float to move upward until the buoyancy force of said float against said upper float closes said valve, providing a greater volume of water in said tank.

15. The method of claim 14, wherein said stops are part of a vertical shaft and said float includes a tab selectively engaging said stops to move said shaft upward.

16. The method of claim 14, wherein said lower stop is moved from said pathway with said flush lever.

17. The method of claim 14, wherein said valve includes an actuator arm, said actuator arm being moved upward by the buoyancy force of said float as water enters said tank.

18. The method of claim 14, wherein said fill valve assembly includes a vertical fill tube, said float being slidable on said fill tube.

19. The method of claim 14, including the step of moving said lower tab into said pathway when said toilet is flushed.

* * * * *